US007445485B1

(12) United States Patent
Wu

(10) Patent No.: US 7,445,485 B1
(45) Date of Patent: Nov. 4, 2008

(54) LATCH MECHANISM WITH PULL TAPE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/900,613

(22) Filed: Sep. 12, 2007

(51) Int. Cl.
*H01R 13/627* (2006.01)

(52) U.S. Cl. ..... 439/352; 439/160; 439/372

(58) Field of Classification Search ..... 439/350, 439/352, 160, 372
See application file for complete search history.

(56) References Cited

U.S. PATENT DOCUMENTS 6,749,448 B2 6/2004 Bright et al.
6,824,416 B2 * 11/2004 Di Mascio ..... 439/352
6,851,867 B2 2/2005 Pang et al.
6,884,097 B2 4/2005 Ice
6,908,323 B2 6/2005 Ice
6,953,356 B2 * 10/2005 Hisamatsu et al. ..... 439/258
6,976,865 B2 * 12/2005 Wu ..... 439/352
7,052,306 B2 5/2006 Ishigami et al.
7,064,959 B2 6/2006 Kim
7,077,578 B2 7/2006 Lee et al.
7,077,686 B2 7/2006 Seo et al.
7,090,523 B2 8/2006 Shirk et al.
7,140,909 B2 * 11/2006 Moritake ..... 439/492
7,226,316 B2 * 6/2007 Wu ..... 439/610
7,281,938 B1 * 10/2007 Wu ..... 439/353

* cited by examiner

*Primary Examiner*—Truc T Nguyen
(74) *Attorney, Agent, or Firm*—Wei Te Chung

(57) ABSTRACT

A plug-in module (100) includes a cover (1) including opposite first sidewalls (11) parallel to each other and a first flange (14), a base (2) including opposite second sidewalls (21) parallel to each other assembled to the first sidewalls of the cover and a second flange (24) parallel spaced from the first flange, and a latch mechanism. The latch mechanism includes an actuator (3) and a pull tape (5). The actuator is sliderably assembled to the first and second sidewalls of the base and the cover and includes a pair of sliding arms (31) formed with actuating ends (312) on distal ends thereof and an operating portion (30) connecting with the pair of sliding arms for being pulled to separate the plug-in module from the module receptacle. The pull tape is assembled to the operating portion for selectively being pulled to separate the plug-in module from the module receptacle. The actuator is stiff and the pull tape is soft.

14 Claims, 7 Drawing Sheets

LATCH MECHANISM WITH PULL TAPE

BACKGROUND OF THE INVENTION

1. Field of the Invention

The present invention generally relates to a plug-in module, and more particularly to a plug-in module used for high-speed transmission.

2. Description of Related Art

SFP (Small Form-factor Pluggable), X-SFP and QSFP are all modules for fiber optic transmission or ordinary signal transmission. All of the modules are of small size or form factor which is important. The smaller the form factor of the module, the less space taken on a printed circuit board to which it couples. A smaller form factor allows a greater number of modules to be coupled onto a printed circuit board to support additional communication channels. However, the smaller form factor makes it more difficult for a user to handle.

When such a module embedded in a system fails, it is desirable to replace it, particularly when other communication channels are supported by other modules. To replace a failed module, it needs to be pluggable into a module receptacle. While, plugging in a new module is usually easy, it is more difficult to remove the failed module because of other components surrounding it. Additionally, a user should not attempt to pull on cables of the module in order to try and remove a failed module or else the user might cause damage thereto.

A typical release method for a pluggable module is to push in on the module itself and then pull out on the module to release it from a cage assembly or module receptacle. It has been determined than this method is not very reliable with users complaining of the difficulty in removing pluggable modules in such manner. Users often complain that traditional methods offer little leverage in getting a sufficient grip on the module when attempting to pull it out of a module receptacle. Another complaint is that traditional actuators used to remove modules are inaccessible or invisible. Other users complain than once released by the traditional method, it is difficult to withdraw the module out of its cage or module receptacle.

Therefore, designers developed different solutions to solve above problems accounted by the users, such as disclosed by U.S. Pat. Nos. 6,851,867, 6,749,448, 6,884,097, 6,908,323, 7,052,306, 6,824,416 and 7,090,523. The theories of theses patents are substantially the same, that is each module is received in corresponding cage or module receptacle and comprises a pair of sliders with forward ends engaging with tabs of the cage, and a bail or lever capable of rotating to actuate the sliders linearly to separate forward ends of the sliders from the tabs. The action theory of theses patents successfully solve the problems mentioned above. However, another problem is raised, that is there is not enough space left for operator's finger operation. The present invention provides a plug-in module with an improved latch mechanism having pull tape for convenient operation to separate the plug-in module from module receptacle.

BRIEF SUMMARY OF THE INVENTION

Accordingly, an object of the present invention is to provide a plug-in module with improved latch mechanism for unplugging the plug-in module conveniently.

In order to achieve the above-mentioned object, a plug-in module configured for latching engagement with a module receptacle adapted for mounting to a printed circuit board comprises a cover comprising opposite first sidewalls parallel to each other and a first flange, a base comprising opposite second sidewalls parallel to each other assembled to the first sidewalls of the cover and a second flange parallel spaced from the first flange, and a latch mechanism. The latch mechanism comprises an actuator and a pull tape. The actuator is sliderably assembled to said first and second sidewalls of the base and the cover and comprises a pair of sliding arms formed with actuating ends on distal ends thereof and an operating portion connecting with the pair of sliding arms for being pulled to separate the plug-in module from the module receptacle. The pull tape is assembled to the operating portion for selectively being pulled to separate the plug-in module from the module receptacle. The actuator is stiff and the pull tape is soft.

Other objects, advantages and novel features of the invention will become more apparent from the following detailed description of the present embodiment when taken in conjunction with the accompanying drawings.

DETAILED DESCRIPTION OF THE INVENTION

Figure 1:
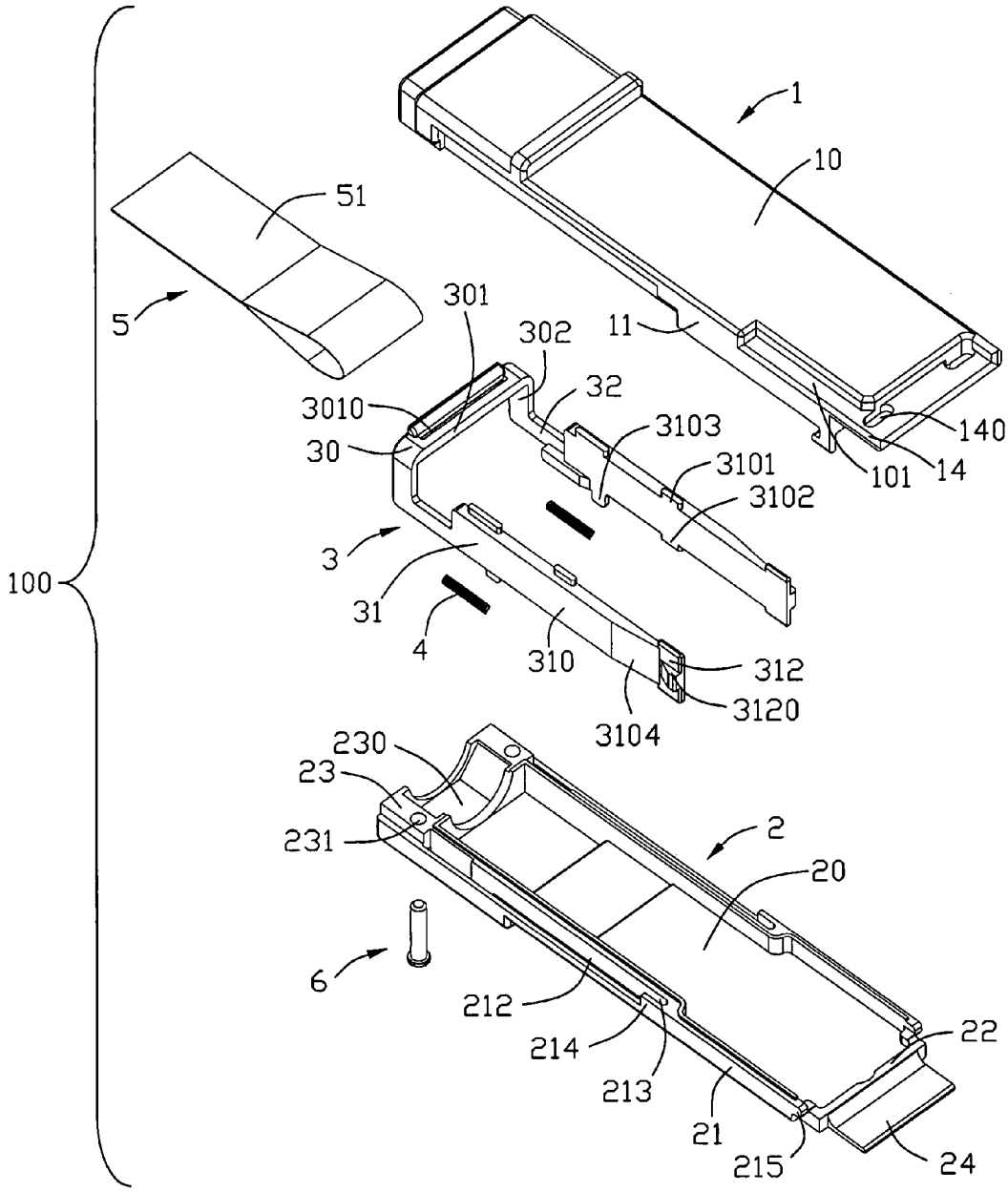
FIGS. 1-2 are exploded, perspective views of a plug-in module in accordance with the present invention and viewed from different aspects.

Reference will now be made to the drawing figures to describe the present invention in detail.

Figure 2:
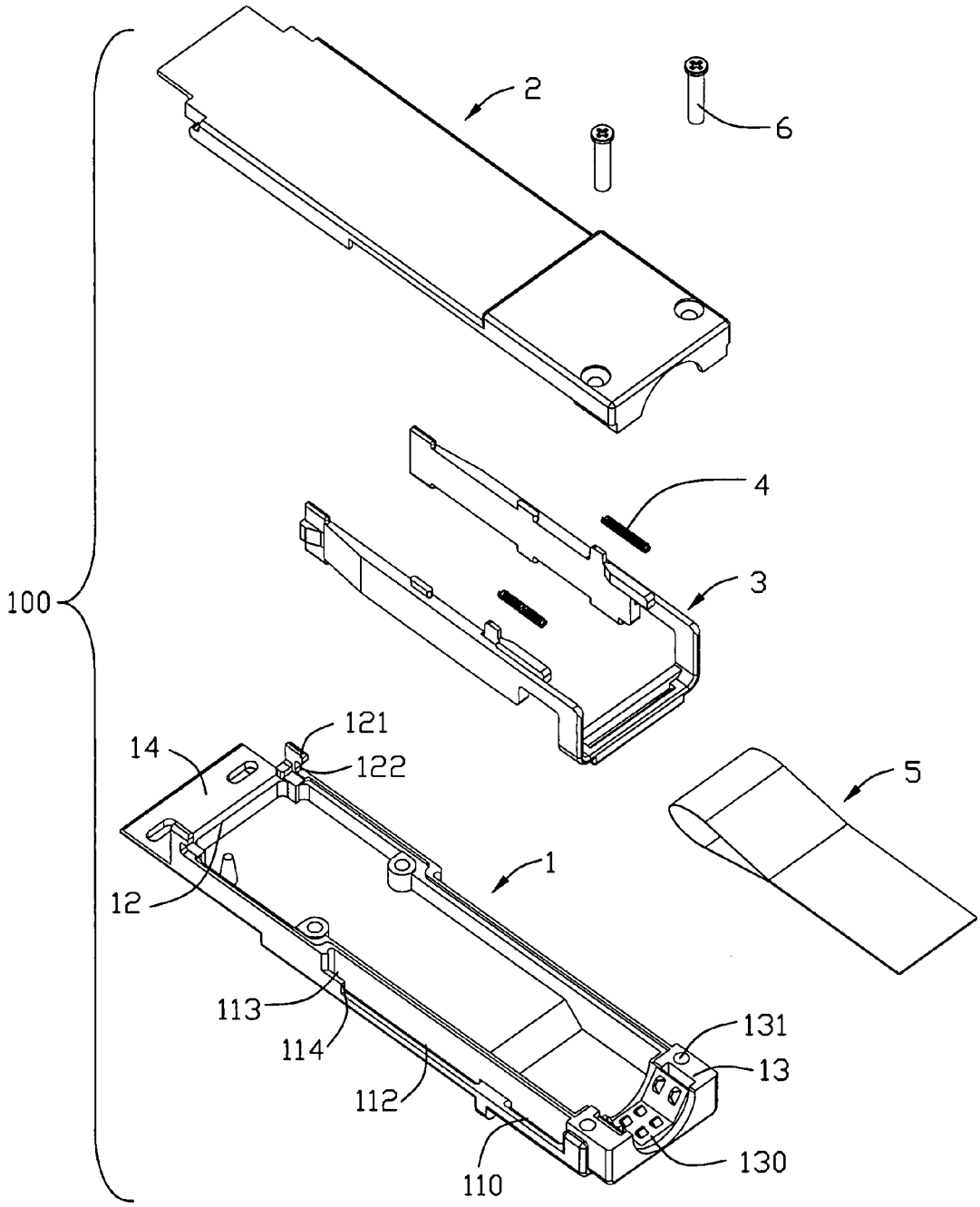

Referring to FIGS. 1-2, a plug-in module 100 in accordance with the present invention comprises a base 2, a cover 1 assembled with the base 2 to form a die case housing 7, and a latch mechanism 8 assembled to the base 2 and the cover 1 for unplugging the plug-in module 100 from a module receptacle (not shown) conveniently. The latch mechanism 8 comprises an actuator 3 assembled to the base 2 and the cover 1, a pair of bias elements 4, which is a pair of springs in the preferred embodiment, assembled to the base 2 and the actuator 3 for providing elastic restoring force to the actuator 3, and a pull tape 5 made from soft insulative material and assembled to the actuator 3 for unplugging the plug-in module 100 from the module receptacle conveniently. In the preferred embodiment, the plug-in module 100 is a QSFP (Quad Small Form-factor Pluggable) module in accordance with Revision 1.0 of the QSFP Transceiver specification released on Dec. 1, 2006. However, the plug-in module 100 also can be other types of modules without betray the spirit of the present invention.

The cover 1 is elongated and comprises a step-shape flat board 10, a pair of first sidewalls 11 and opposite first front and rear walls 12, 13 respectively extending downwardly from the flat board 10. Further, the flat board 10 extends forwardly beyond the first front wall 12 to form a first flange 14. An L-shape cutout 101 is recessed downwardly from upper surface of the flat board 10 and occupies one corner of the flat board 10 for preventing excessive insertion of the plug-in module 100. A pair of elliptic-shape holes 140 are spaced arranged on the first flange 14. The first rear wall 13 defines a semicircular first exiting opening 130 for the existence of a cable and a pair of first screw-receiving holes 131 at opposite sides of the exiting opening 130. A pair of L-shape tip ends 121 are formed with opposite ends of the first front wall 12, thus, forming a pair of engaging recesses 122 between the tip ends 121 and the first sidewalls 11. Outer and lower sides of each first sidewall 11 are partially cut to form a thinner inner part and an upper part. A rear sliding channel 110, a front sliding channel 112 spaced from the rear sliding channel 110 are recessed upwardly into the upper part, and a front receiving space 113 communicating with the front sliding channel 112 are formed between the inner part and an L-shape outer part 114 of the first sidewall 11.

The base 2 comprises a step-shape flat board 20, a pair of second sidewalls 21, and opposite second front and rear walls 22, 23 respectively upwardly extending from the flat board 20. Further, the flat board 20 extends forwardly beyond the second front wall 22 to form a second flange 24 parallel spaced from the first flange 14. The second rear wall 23 defines a semicircular second exiting opening 230 and a pair of second screw-receiving holes 231 respectively corresponding to the first exiting opening 230 and the first screw-receiving holes 131. Lower and outer parts of each second sidewall 21 are partially cut to leave thinner inner part and lower part. A deeper rear bias-receiving slot 210 (FIG. 5), a front sliding channel 212 are recessed downwardly from lower part of the second sidewall 21, and a front receiving space 213 is formed between the inner part and an L-shape outer part 214 of the second sidewall 21.

The actuator 3 is die casted from metal material and comprises a U-shape operating portion 30, a pair of sliding arms 31, and a pair of horizontal connecting portions 32 connecting with the operating portion 30 and the sliding arms 31. The operating portion 30 comprises a horizontal section 301 and a pair of vertical sections 302 connecting with the horizontal section 301. The horizontal section 301 defines a slit 3010 in the middle thereof for tying the pull tape 5. Each sliding arm 31 comprises a main section 310 located in a vertical plane, and an actuating end 312 formed at distal end of the main section 310. The main section 310 forms a pair of first protrusions 3101 arranged on upper surface thereof along front-to-back direction, and a second protrusion 3102 on lower surface thereof and aligning with one first protrusion 3101 along vertical direction. A compressing portion 3103 with higher height is formed below one first protrusion 3101 for compressing the bias element 4 forwardly move. The actuating end 312 is higher than the main portion 310 with a wedge-shape latching projection 3120 formed on outer surface thereof.

The pull tape 5 is a soft belt with a certain width and comprises opposite ends.

Figure 3:
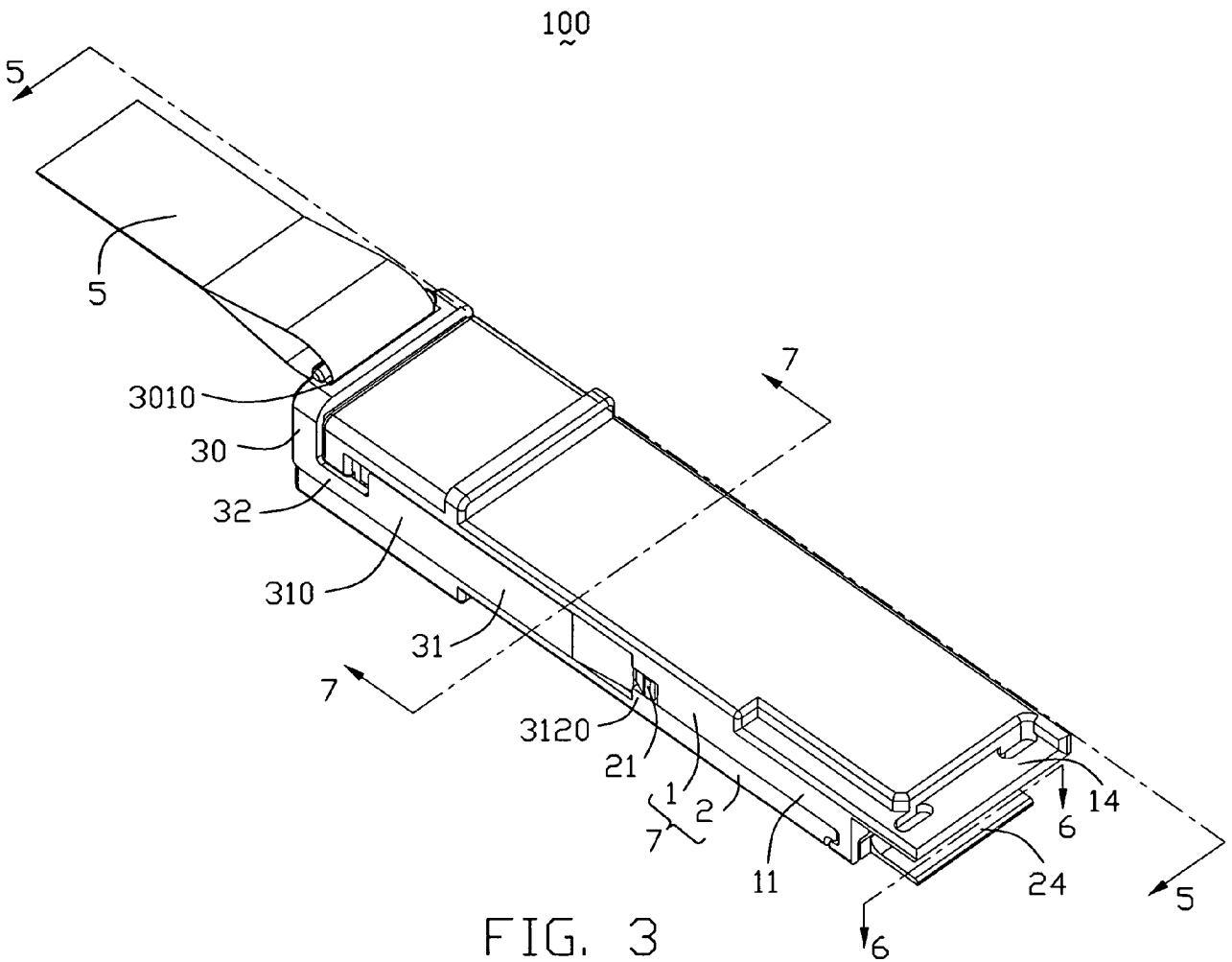
FIGS. 3-4 are partially assembled views of FIGS. 1-2.
Figure 4:
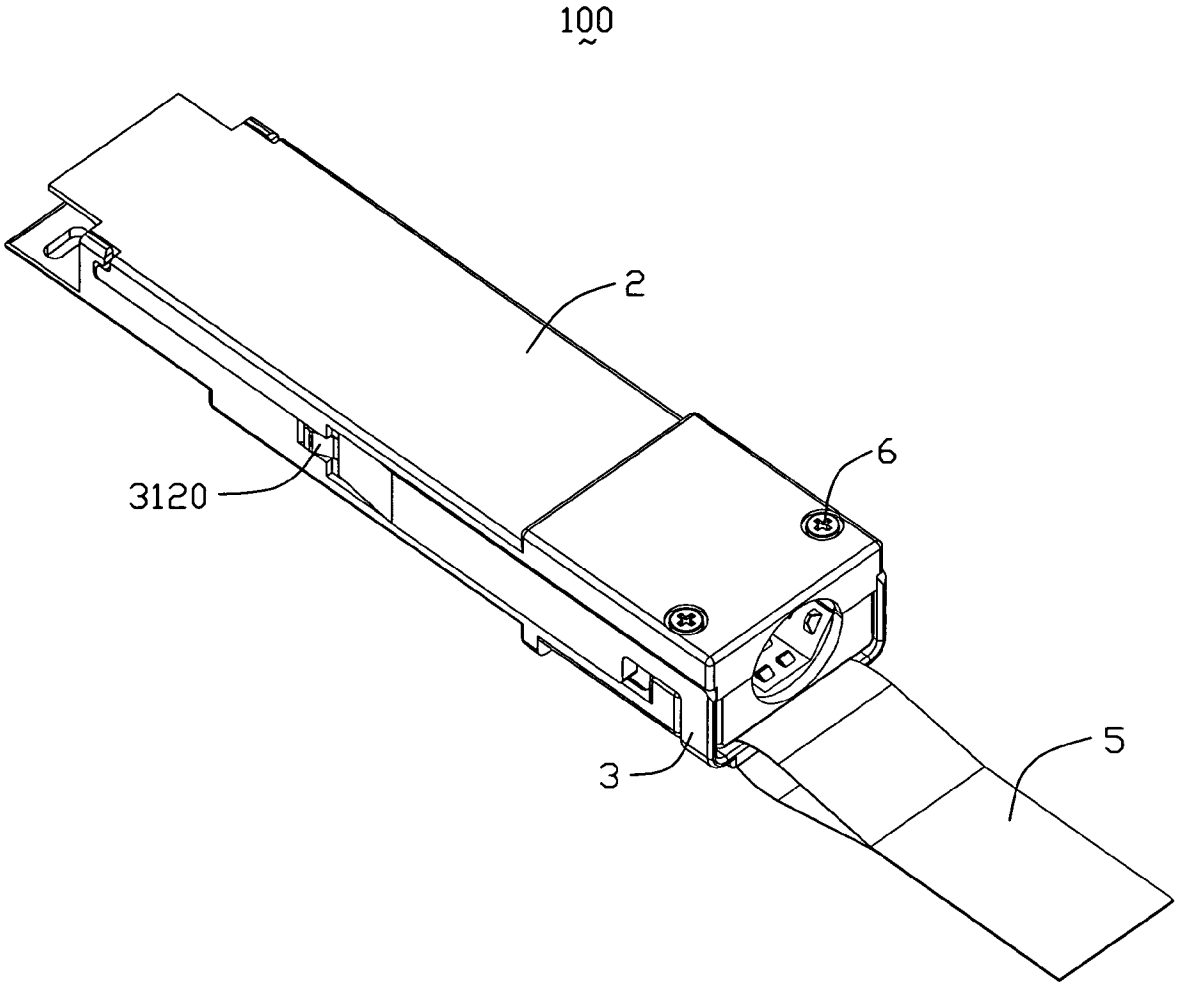
Figure 5:
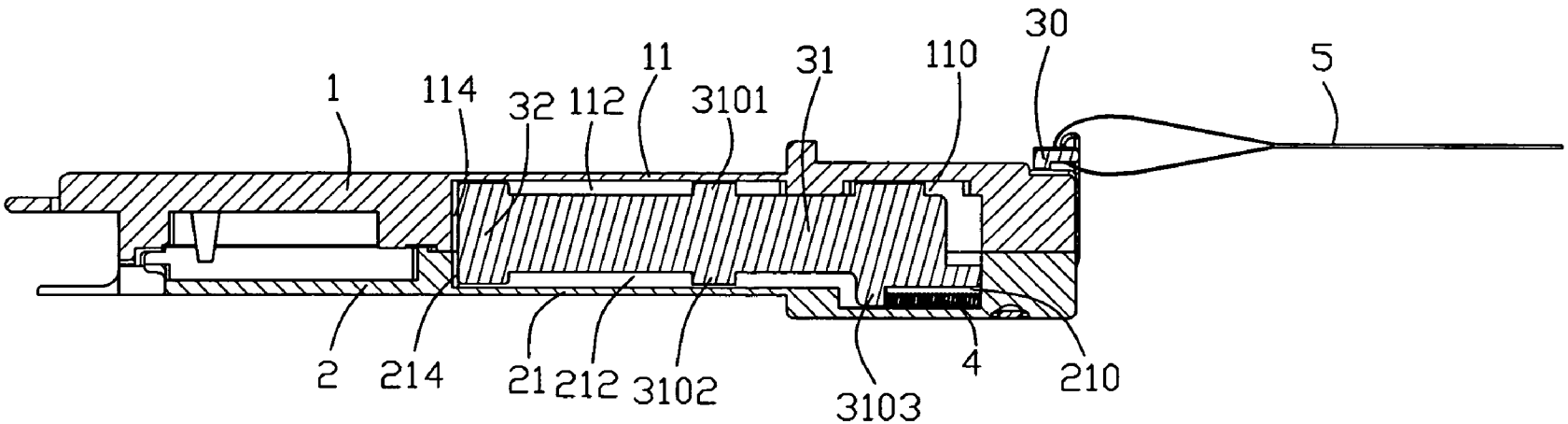
FIGS. 5-7 are cross-section views of the plug-in module taken along lines 5-5 to 7-7 of FIG. 3.
Figure 6:
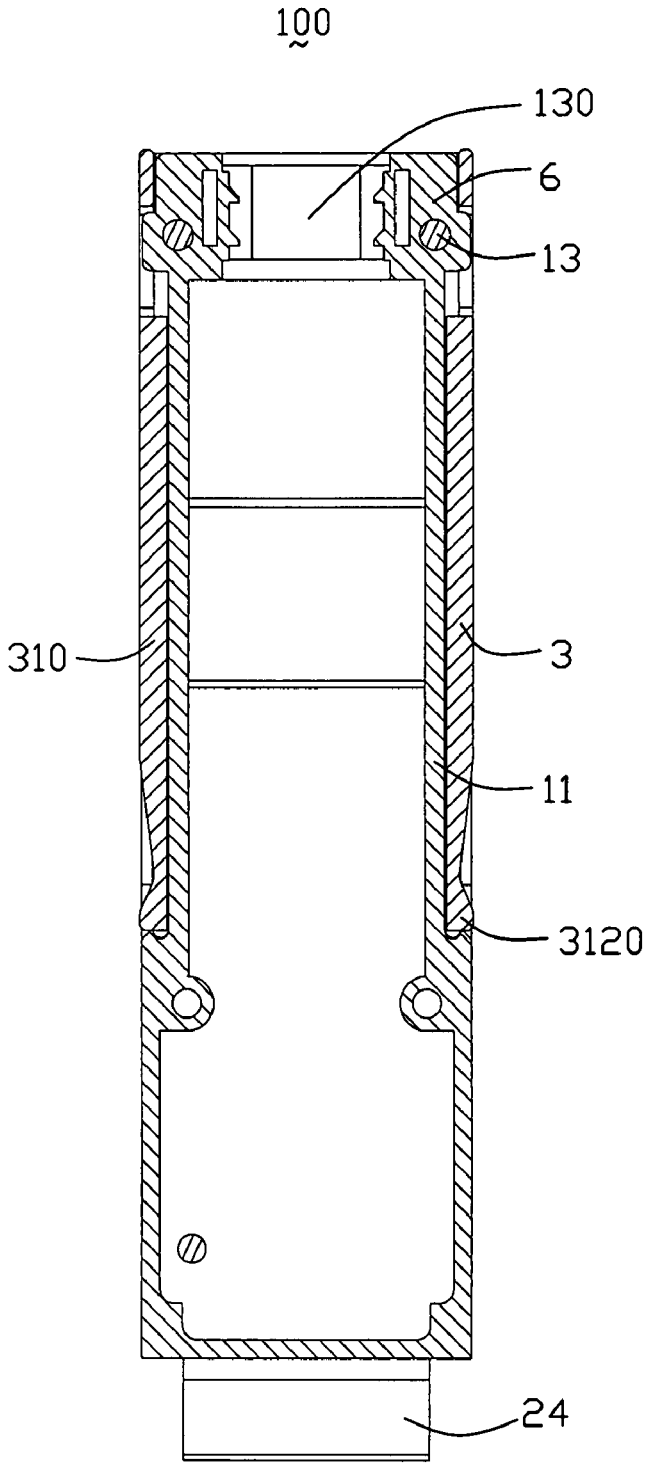
Figure 7:
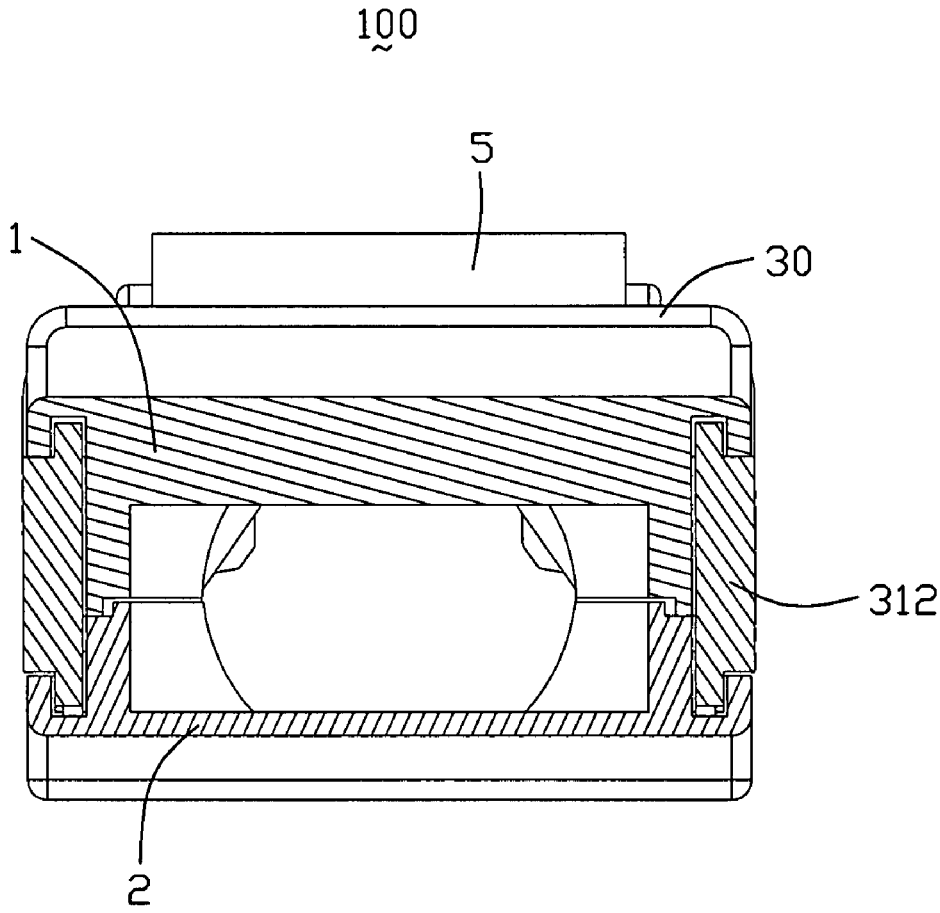

In assembly, referring to FIGS. 3-4 in conjunction with FIGS. 5-7, the actuator 3 is firstly assembled to the cover 1 with the operating portion 30 located above the cover 1, the first protrusions 3101 respectively received in the front and rear sliding channels 110, 112 and the outer surfaces of the sliding arms 31 are substantially coplanar with that of the first sidewalls 11 and the actuating ends 312 are partially received in the front receiving spaces 113 of the first sidewalls 11. The pull tape 5 protrudes through the slit 3010 then the opposite ends thereof are sticked to each other to form a handling portion 51 for being pulled by an operator to pull the actuator 3 rearwardly move. The pair of bias elements 4 are put into the bias-receiving slots 210. The cover 1 and the actuator 3 and the pull tape 5 are assembled to the base 2 with forward tip ends 215 of the second sidewalls 21 inserted into the engaging recesses 122 of the cover 1 and the cover 1 rotating downwardly until combined with the base 2. The compressing portions 3103 insert into the bias-receiving slots 210 to locate in front of corresponding bias elements 4. The second protrusions 3102 insert into the rear sliding channels 212 of the second sidewalls 21 and the lower parts of the actuating ends 312 are received in the receiving spaces 213 with the latching projections 3120 exposed in the space formed by the outer parts 114, 214. A pair of screws 6 protrude through the first and second screw-receiving holes 131, 231 to fasten the base 2 and the cover 1 together. In addition, before assembling the cover 1 to the base 2, a printed circuit board (not shown) with conductive pads on front and rear ends thereof and a cable (not shown) having a plurality of conductors may be assembled to the base 2 then to the cover 1, with front end of the printed circuit board disposed between the first and second flanges 14, 24 and the conductors of the cable electrically connecting with the conductive pads of the printed circuit board and exiting from the first and second exiting openings 130, 230.

After the above assembly, the plug-in module 100 is achieved. When removing the plug-in module 100 from the module receptacle, operator may grasp the handling portion 51 of the pull tape 5 and exerts a rearward force to the pull tape 5. The actuator 3 is pulled rearward with the compressing portions 3103 compressing the bias elements 4 to rearwardly move, the first and second protrusions 3101, 3102 sliding in the sliding channels 112, 114 212. With the rearward movement of the actuator 3, the latching projections 3120, which originally latch with tabs of the module receptacle, push the tabs outwardly move to disengage the plug-in module 100 from the module receptacle. When release the pulling force to the bail 3, the compressed bias elements 6 resume to their original statement, thus, providing elastic restore force to the actuator 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug-in module configured for latching engagement with a module receptacle adapted for mounting to a printed circuit board, comprising:

a cover comprising opposite first sidewalls parallel to each other and a first flange;

a base comprising opposite second sidewalls parallel to each other assembled to the first sidewalls of the cover and a second flange parallel spaced from the first flange; and a latch mechanism comprising:

an actuator sliderably assembled to said first and second sidewalls of the base and the cover and comprising a pair of sliding arms formed with actuating ends on distal ends thereof and an operating portion connecting with the pair of sliding arms for being pulled to separate the plug-in module from the module receptacle; and a pull tape assembled to the operating portion for selectively being pulled to separate the plug-in module from the module receptacle; wherein the actuator is stiff and the pull tape is soft;

wherein the cover defines an L-shape cutout adjacent to the first flange for preventing excessive insertion of the plug-in module into the module receptacle;

wherein the operating portion of the actuator defines a slit therein;

wherein the pull tape protrudes through the slit with opposite ends thereof attached to each other.

2. The plug-in module as claimed in claim 1, wherein each of the first and second sidewalls defines a first and second sliding channels, and wherein each sliding arm forms a pair of first and second protrusions on opposite upper and lower edges to sliderably received in the first and second sliding channels.

3. The plug-in module as claimed in claim 1, wherein the actuating end forms a latching projection on outer surface thereof for latching with and detaching from the module receptacle.

4. The plug-in module as claimed in claim 1, further comprising a pair of bias elements assembled to the base, and wherein the actuator forms a pair of compressing portions received in the base and behind the bias elements for compressing the bias elements to provide elastic restore force to the actuator.

5. The plug-in module as claimed in claim 1, wherein the pair of bias elements are a pair of springs.

6. The plug-in module as claimed in claim 1, further comprising a printed circuit board retained between the base and the cover, and wherein front end of the printed circuit board is located between the first and second flanges.

7. The plug-in module as claimed in claim 1, wherein the outer surfaces of the sliding arms are substantially coplanar with the first and second sidewalls.

8. The plug-in module as claimed in claim 6, further comprising a cable electrically connecting with rear end of the printed circuit board and exiting from the base and the cover.

9. A plug-in module capable of engaging with a module receptacle, comprising:

a housing comprising a pair of sidewalls and a rear surface; and a latch mechanism comprising:

a first pulling member comprising a pair of sliding arms assembled to the sidewalls and capable of sliding along the sidewalls, an operating portion connecting with the sliding arms and a pair of actuating ends formed at free ends of the sliding arms adapted for latching with a tab of said module receptacle; and a second pulling member attaching to the operating portion of the first pulling member; and wherein the operating portion of the first pulling member is substantially coplanar with the rear surface of the housing and the sliding arms are substantially coplanar with the sidewalls of the housing; and wherein the second pulling member is exposed beyond the rear surface of the housing;

wherein the rear surface defines an L-shape cutout for preventing excessive insertion of the plug-in module into the module receptacle;

wherein the operating portion of the first pulling member defines a slit therein;

wherein the second pulling member protrudes through the slit with opposite ends thereof attached to each other.

10. The plug-in module as claimed in claim 9, wherein the first pulling member is stiff and the second pulling member is soft.

11. The plug-in module as claimed in claim 9, wherein the housing forms a pair of parallel first and second flanges at forward end thereof adapted for engaging with the module receptacle.

12. The plug-in module as claimed in claim 9, wherein the housing defines an L-shape cutout on upper surface thereof and adjacent to the first flange.

13. A plug-in module capable of engaging with a module receptacle, comprising:

a housing comprising a pair of sidewalls and a rear face adapted to be releasably coupled to the module receptacle; and a latch mechanism comprising:

a rigid first pulling member being moveable relative to the housing, and comprising a pair of sliding arms assembled to the sidewalls and capable of sliding along the sidewalls, an operating portion connecting with the sliding arms and a pair of actuating ends formed at free ends of the sliding arms, said actuating ends adapted to be located adjacent to a tab of said module receptacle;

an biasing device constantly urging the first pull member toward a rear position; and a flexible second pulling member attaching to the operating portion of the first pulling member; wherein a linking position between the first pulling member and the second pulling member is located around an edge of a front face of said housing so as not to interfere with a related part connected on the front face of the housing;

wherein the rear surface defines an L-shape cutout for preventing excessive insertion of the plug-in module into the module receptacle;

wherein the operating portion of the rigid first pulling member defines a slit therein;

wherein the flexible second pulling member protrudes through the slit with opposite ends thereof attached to each other.

14. The plug-in module as claimed in claim 13, wherein the first pulling member is linearly moved with regard to the housing.

* * * * *